US005232268A

United States Patent [19]

Dengler et al.

[11] Patent Number: 5,232,268

[45] Date of Patent: Aug. 3, 1993

[54] METHOD OF BREAKING A FULL FACE OF ROCK FOR CONSTRUCTING SHAFTS AND TUNNELS

[75] Inventors: William R. Dengler, Nobleton; William M. Shaver, Stouffville, both of Canada

[73] Assignee: Dynatec Mining Limited, Richmond Hill, Canada

[21] Appl. No.: 904,724

[22] Filed: Jun. 26, 1992

[30] Foreign Application Priority Data

Apr. 1, 1992 [CA] Canada ..... 2064625

[51] Int. Cl.[5] ..... E21C 7/12; F42D 3/04

[52] U.S. Cl. ..... 299/13; 102/312; 173/184

[58] Field of Search ..... 299/13, 57; 102/311, 102/312, 313; 173/28, 184

[56] References Cited

U.S. PATENT DOCUMENTS

| | | | |
|---|---|---|---|
| 2,772,632 | 12/1956 | Aitchison et al. | 102/312 |
| 3,957,124 | 5/1976 | Desourdy | 173/28 |
| 3,967,686 | 7/1976 | Fögelström | 173/184 |

OTHER PUBLICATIONS

*Blasters Handbook* 15th Edition, DuPont Canada Inc., Chapters 16, 17, pp. 245–279, 1969.

*Blasters Handbook*, Canadian Industries Limited, Chapter VII pp. 215–257, 1968.

E/MJ Article "Open-pit concepts boost Inco productivity underground" pp. 101–104, May 1975.

Singh, S. P., "Empirical Guidelines for Drift Blasting", (1990) vol. 11 Mining Science and Technology, pp. 37–44.

Hagan, T. N., "Understanding the Burn Cut—A Key to Greater Advance Rates", pp. 2–8 (1979) Tunnelling 1979, Institution of Mining and Metallurgy.

Canadian Industries Limited, "Driving the Diversion Tunnel at Manic 3", Explosives Bulletin, 1972.

*Primary Examiner*—David J. Bagnell

*Attorney, Agent, or Firm*—Bereskin & Parr

[57] ABSTRACT

A method for breaking a longer round more efficiently in a full face of rock, to construct shafts or tunnels. In the method a relief hole having at least a 200 mm diameter and at least a 15 to 18 foot depth is drilled. Primary and secondary blast holes are drilled about the relief hole, approximately axially parallel to the relief hole. Most of the blast holes are drilled simultaneously with the relief hole. The relief hole is drilled by an in-the-hole (ITH) hammer drill, which if necessary is removed after drilling the relief hole, to allow blast holes to be drilled immediately adjacent the relief hole. The relief hole is drilled at least 10 to 15 percent deeper than the blast holes. Explosive charges are then inserted into the relief hole and most of the blast holes and are detonated in sequence.

11 Claims, 6 Drawing Sheets

METHOD OF BREAKING A FULL FACE OF ROCK FOR CONSTRUCTING SHAFTS AND TUNNELS

FIELD OF THE INVENTION

The present invention relates to a method and apparatus for breaking a full face of rock using explosive rounds, as applied to the construction of shafts and tunnels.

BACKGROUND OF THE INVENTION

Shaft and tunnel excavation in hard rock involves three distinct operations, namely drilling and blasting; mucking (i.e. removing the broken rock); and then lining the shaft or tunnel (stabilizing it with rock bolts, screen, steel or concrete), and equipping the shaft or tunnel. To improve the daily rate of excavation, the mucking, lining and equipping operations may be optimized largely by upscaling the equipment used. However the drilling and blasting operations are much less easily amenable to being optimized, and the method of drilling and blasting, and the skill of the driller, usually determine the daily advance rate. The present invention is concerned with improving the drilling and blasting operation by providing an improved method for breaking a full face of rock and an apparatus for carrying out the method.

The full face method of mine shaft excavation is well known in the mining industry. This method involves the breakage and removal of rock or earth over the "full face" or full intended diameter of the shaft. This may be contrasted with the benching method of shaft excavation which involves breaking and excavating smaller portions of the "face" of the shaft by creating a series of benches or steps.

The full face method has been successfully used in many countries in the world and particularly South Africa, where in the past, lower labour costs and large drilling and bottom cleaning crews have resulted in high speed shaft sinking rates. The South African method employed a V-cut for excavating the full face. Blast holes in the V-cuts were drilled by a mechanized shaft drilling machine. One difficulty with this method of shaft construction was that because blasting a V-cut throws rock a long distance, the sinking stage had to be moved a large distance (at least 200 feet) from the shaft bottom before blasting. This was time consuming and inefficient. In addition, the process of equipping the shaft could not be carried on simultaneously with excavation. This led to a less efficient rate of shaft completion. Further, the V-cut limited the length of round (i.e. the depth for each blast cycle) that could be blasted.

An alternative method for breaking a full face of rock is the "shatter" or "burn" cut. This method offers the advantage over the V-cut method of only having to raise the sinking stage a short distance (approximately 30 feet) from the shaft bottom in shaft sinking. When tunnelling, the broken rock is not thrown as far along the tunnel, reducing cleaning time. However a major disadvantage of the burn cut (as will be described further below) is the high degree of skill required to break the cut to the full extent drilled.

More specifically, the shatter cut method involves drilling a number of holes into the rock. Nearly all the holes are filled with explosives and act as blast holes. A small number of holes are left uncharged to act as relief holes into which the fragmented rock may expand. During blasting, provided that the holes have been properly drilled and charged, the compression or strain waves travelling through the rock fragment or shatter the rock (hence the name), without throwing the rock long distances.

Many different patterns of relief holes and blast holes have been used in association with the shatter cut method. It is well recognized however that, regardless of the pattern chosen, proper spacing and alignment of the blast holes relative to the relief holes is necessary to successfully break the rock to the entire desired number of "bootlegs" may exist (bootlegs are the remnants of blast holes at the base of the round) as well as brittle, partially fragmented rock. The existence of such bootlegs and such brittle rock can present a major hazard to workers and may seriously delay the excavation of the next stage of the shaft, since they must all be marked, and no drilling can occur closer than 6 inches to them. However they can be difficult to find, since they may be hidden under broken rock and/or water.

It has been found that the shatter cut method achieves its best results in rock fragmentation when the blast holes are drilled exactly parallel to the free face (inside surface) of the relief holes. Parallel holes ensure that the cylindrically expanding compressive strain wave radiating from the detonated blast hole is reflected back 180° upon meeting the free face of the relief hole. This reflection increases the occurrence of reflection breakage or "spalling" and allows for greater fragmentation of the rock, reducing the likelihood of bootlegs and brittle rock fragments.

It has further been found that there is a critical radial distance between the blast hole and the relief hole beyond which effective fragmentation is less likely to occur. The "radial cracking" caused by the compressive strain wave radiating from the blast hole, and the "spalling" caused by the reflected strain wave radiating from the relief hole, together influence rock fragmentation. As the radial distance between the blast hole and the relief hole increases, the influences of "radial cracking" and "spalling" upon rock fragmentation decrease. Beyond the critical radial distance, successful breakage of the round is jeopardized. As a consequence, blast holes are typically drilled slightly within this critical radial distance from the relief hole.

Great care must be taken to ensure that the above factors are met. A non-parallel blast hole may decrease the occurrence of "spalling" and also may stray beyond the critical radial distance from the relief hole at some point along the depth of the round and affect the success of rock fragmentation. However, achieving such parallelism, particularly for long holes and in hard rock, is extremely difficult and a highly skilled driller is required. Moreover, since the characteristics of rock in one geographic area may differ greatly from those of rock in another geographic area, a driller experienced at one locality may have difficulty drilling long parallel holes at another locality.

One way to improve rock fragmentation is to drill larger diameter relief holes. The greater area of the free face of the larger relief holes increases the influences of "radial cracking" and "spalling" upon the rock. However relief holes having a diameter greater than 150 mm (6 inches) have not normally been used in practice because of the difficulties in drilling these holes. Because the equipment used to drill large relief holes has been so large, therefore on the few occasions on which large relief holes have been drilled, it has been necessary first to drill the relief hole and then afterwards to drill the individual blast holes around the relief hole. The two stage drilling process has been so time consuming that the benefits associated with drilling large diameter relief holes have been lost. Shaft sinking and tunnel excavation in hard rock have therefore for many years been a relatively slow and costly process.

SUMMARY OF THE INVENTION

The present invention provides a method according to which large relief holes and smaller blast holes are drilled simultaneously, for both vertical shafts and horizontal tunnels. The invention also provides apparatus for carrying out this method. With the method and apparatus of the invention, excavation rates can be increased substantially, and the degree of skill required to drill the various holes can be reduced.

Accordingly, the invention in one aspect provides a method for breaking a long round in a full face of rock, for use in the construction of shafts and tunnels, said method comprising the following steps:

(a) drilling a relief hole having a first diameter of at least 200 millimeters and a first depth, said first depth being at least 4.5 meters, and simultaneously with the drilling of said relief hole, drilling a plurality of primary and secondary blast holes about said relief hole, said blast holes being approximately axially parallel to said relief hole and having a second depth and a second diameter each of which is respectively less than said first depth and said first diameter, where the periphery of each of said primary blast holes is located less than a critical radial distance from the periphery of said relief hole as measured from the nearest points between the peripheries of the respective holes, and where said secondary blast holes are located a further distance radially from said relief hole than said primary blast holes, (b) inserting explosive charges into said relief hole and into a plurality of said primary and secondary blasting holes, (c) detonating said charges in a prearranged detonation sequence with the explosive charges in said relief hole being detonated first, and the explosive charges in said primary blast holes being detonated next.

In another aspect the invention provides apparatus for drilling relief holes and blast holes for blasting a full face of rock in a tunnel, said apparatus comprising:

(a) a vehicle having a chassis, (b) an in-the-hole hammer drill for drilling relief holes, said in-the-hole hammer drill comprising a drill string movably mounted on a feed rail, said drill string being of a diameter for drilling relief holes of at least 200 mm diameter, (c) a lower support member for supporting said feed rail, said feed rail being movably mounted on said lower support member, and (d) a plurality of electric hydraulic drills for drilling blast holes, each electric hydraulic drill being mounted on a boom and each said boom being mounted on said chassis, so that said relief hole and said blast holes can be drilled simultaneously.

DESCRIPTION OF PREFERRED EMBODIMENTS

Figure 1:
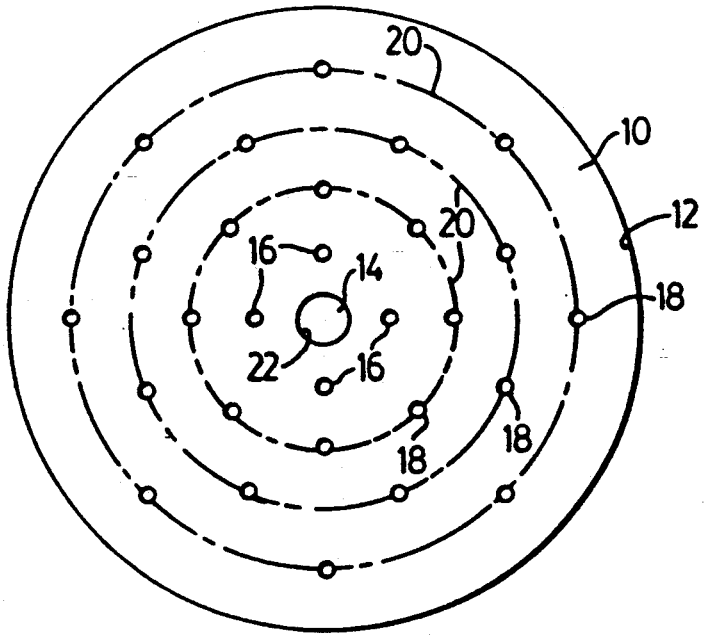
FIG. 1 is a plan view showing a suggested arrangement of blast holes about a relief hole in order to carry out the method of the present invention to blast a 5.5 meter (18 foot) round.

As discussed, the present invention may be used for excavating either a vertical shaft or a horizontal tunnel. FIG. 1 shows a full face 10 of rock at the bottom of a circular shaft 12. A large central relief hole 14 has been drilled in face 10. Four smaller primary blast holes 16 are arranged about the relief hole 14. Secondary blast holes 18 are arranged in concentric rings (indicated by lines 20) about the primary blast holes 16. The interior surface 22 of the relief hole 14 provides an initial free face into which the compressive strain wave radiating from the detonated primary blast holes 16 may break.

An in-the-hole (ITH) hammer drill, to be described presently, is preferably used for drilling the relief hole 14. ITH hammer drills, in which the hammer is located in the drill pipe in the hole, are capable of drilling large diameter holes to great depths. Such drills are supplied by companies such as Atlas Copco, Ingersoll-Rand, Gardner-Denver, and many others. ITH drills are normally individually crawler mounted, but the present invention contemplates that they be used in a different fashion, as will be described.

The relief hole 14 has a diameter of at least 200 mm (approximately 8 inches) and is preferably 250 mm diameter (approximately 10 inches) or larger. It has been found that a relief hole 14 of 250 mm diameter will provide excellent results for rounds up to about 9.1 meters (30 feet) in length. (A "round" is the common name for the operations of drilling and blasting.)

Large diameter relief holes pose a problem for the removal of cuttings. This problem is solved by over-drilling the relief hole to a depth exceeding that of the blast holes 16, 18, typically at least ten percent of the depth of these blast holes. Further advantages associated with such over-drilling will be discussed below.

Figure 2:
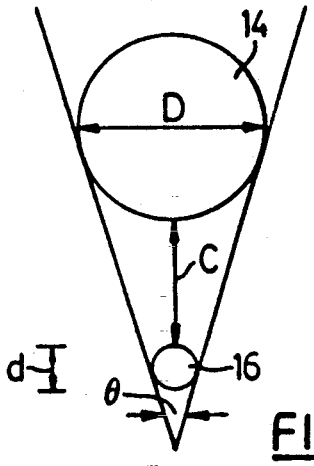
FIG. 2 is a diagram showing a blast hole and a relief hole and indicating the preferred critical radial distance between the holes when blasting a 5.5 meter (18 foot) round.

As is well known, because of the curved surface of the periphery of the relief hole 14, the effectiveness of the breakage of rock into the free face 22 decreases as the distance from the periphery of a primary blast hole 16 to points along the surface of the relief hole increases. FIG. 2 depicts a primary blast hole 16 and a relief hole 14 separated by a critical radial distance C. FIG. 2 further shows a crater angle $\theta$ which is the angle between the intersection of lines tangent to the peripheries of the primary blast hole 16 and the relief hole 14. In current practice, a crater angle $\theta$ of approximately 30° is considered adequate to allow effective fragmentation to occur. To determine the critical radial distance C the following formula may be used:

$$C = \frac{D}{2}\left(\operatorname{cosec}\frac{\theta}{2} - 1\right) - \frac{d}{2}\left(\operatorname{cosec}\frac{\theta}{2} + 1\right)$$

where D is the diameter of the relief hole 14 and where d is the diameter of the primary blast hole 16.

Thus for a relief hole 14 having a first diameter D of approximately 250 millimeters; a primary blast hole 16 having a second diameter d of approximately 40 millimeters; and a crater angle $\theta$ of 30°; the critical radial distance C will be approximately 260 millimeters. Alternatively, for a relief hole 14 having a first diameter D of approximately 200 millimeters; a blast hole 16 having the same second diameter d of approximately 40 millimeters; and a crater angle $\theta$ of 30°; the critical radial distance C will be approximately 189 millimeters.

Although the primary blast holes 16 may be drilled at this critical radial distance C from the periphery of the relief hole 14, the blast holes 16 in such case must be exactly parallel to the relief hole 14 to ensure that the radial distance between the periphery of the blast hole and the relief hole does not exceed the critical radial distance at any point along its depth. It is nearly impossible to achieve such accuracy. To allow for a greater margin of error and thus to reduce the skill required to drill blast holes, the present method contemplates the drilling of the primary blast holes 16 at a radial distance of approximately 100 mm from the periphery of the relief hole 12. (This distance can vary, depending on the size of the relief and blast holes and the desired safety margin from the critical distance.) This increases the crater angle $\theta$ and allows for minor imperfections in the parallel drilling of the blast holes relative to the relief hole. Thus, it is possible for a less experienced driller successfully to drill blast holes within the critical radial distance tolerances. This allowance for error enables the blast holes to be drilled at a faster rate and at a lower labour cost.

As shown in FIG. 1, there are preferably four primary blast holes 16 arranged about the relief hole 14. The primary blast holes are located at generally equal intervals about the relief hole. A greater or fewer number of primary blast holes 16 may be used, but it has been found that four holes will provide optimum rock fragmentation with minimum drilling costs.

The secondary blast holes 18 can be arranged in a number of different known patterns beyond the primary blast holes 14. For example blast holes 18 can be arranged in an expanding array of circular formations (as shown) or in rectangular formations concentric with the relief hole 14, or they can be arranged in a spiral configuration. In practice, blast holes 16, 18 are typically 45 mm (1.75 inches) in diameter, and blast holes 16 are typically about 100 mm (4 inches) from relief hole 14 (measuring between the peripheries of the holes).

Figure 3:
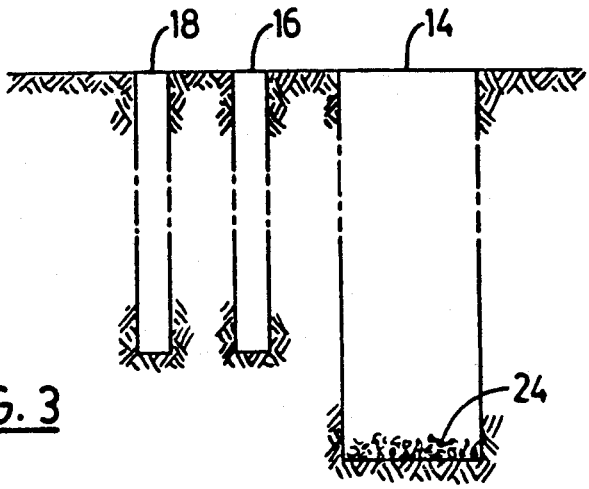
FIG. 3 is a partial sectional side view of a blast hole and a relief hole for blasting a 5.5 meter (18 foot) round.

FIG. 3 shows a partial sectional view of relief hole 14 and blast holes 16, 18 drilled into the rock face 10. As shown, the relief hole 14 is deeper than the blast holes 16, 18, and the holes are all generally axially parallel. The relief hole 14 is preferably at least 5% to 10% deeper than the blast holes 16, 18 (which are all the same depth), although the overdrilling can be 15% or more of the depth of the relief hole 14. For 9.1 meter (30 foot) rounds in shafts, the relief hole 14 has typically been drilled 5 feet deeper (i.e. to 35 feet) than the blast holes. For horizontal rounds, it is found that the overdrilling of the relief hole 14 can be less, typically 5% or about 0.5 meters (1.5 feet) for a 9.1 meter round.

As discussed, it is found that the large, deeper relief hole greatly reduces the likelihood of bootlegs. The deeper relief hole 14 also provides a reservoir for cuttings 24 remaining in the hole after the hole has been drilled and reamed.

After the relief hole and blast holes have been drilled, explosive charges are inserted into most, if not all, of the primary and secondary blast holes 16, 18. In addition, a small charge is placed within the relief hole 14. The charge in the relief hole 14 is detonated first; next the charges in the primary blast holes 16 are detonated simultaneously, and then the charges in the first ring 20 of secondary blast holes 18 are detonated. The detonation sequence continues in an outward direction from the relief hole 14 along the concentric rings of secondary blast holes 18.

The initial detonation of the charge in the relief hole 14 removes any water from the relief hole immediately before the subsequent detonation of the primary blast holes 16. The removal of water from the relief hole improves the degree of rock fragmentation provided by spalling. If the water is not removed, it can act as a solid mass, interfering with fragmentation. It is found that the blast holes near the relief hole 14 actually "over-break", i.e. they break slightly beyond their drilled depth, thereby optimizing the advance or break for the round.

Figure 4:
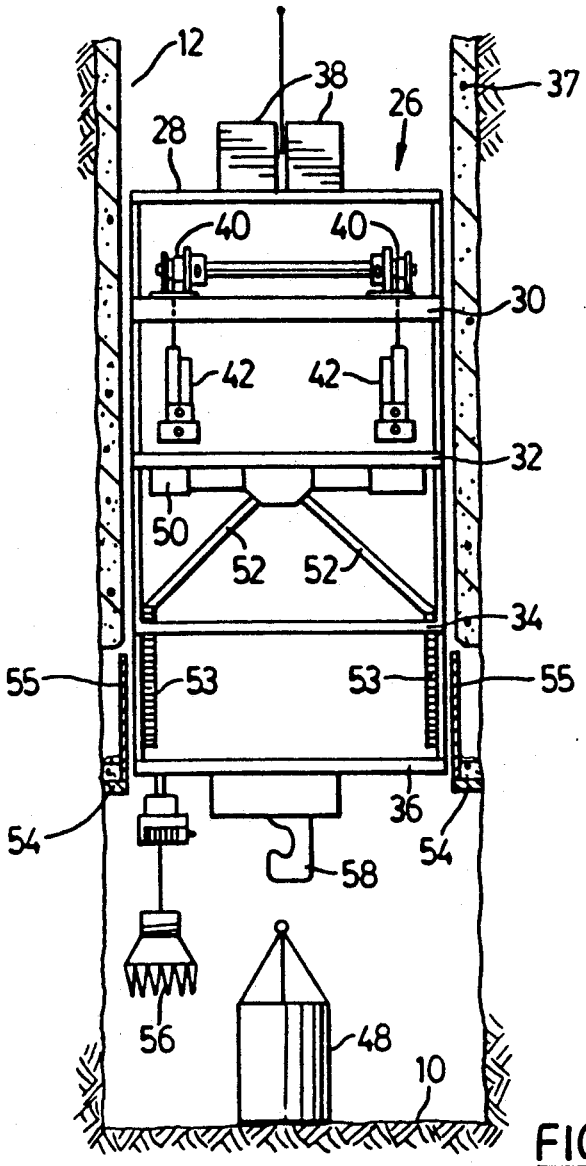
FIG. 4 is a diagrammatic side view of a stage organized according to the invention for sinking shafts.

Reference is next made to FIG. 4, which shows a typical stage 26 according to the invention. The stage 26 is placed in a shaft 12 being sunk and is suspended by a hoist (not shown) located at the top of the shaft for movement of the stage up and down the shaft. The stage 26 typically has five decks, namely a mezzanine deck 28, a top deck 30, intermediate decks 32, 34, and a bottom deck 36. The mezzanine deck 28 is simply a flat upper surface on which workers stand to install the shaft steel or furnishings after the shaft lining 37 (usually of concrete) has been poured. Safety doors 38 in the mezzanine deck 28 open and close to let buckets and other equipment pass through.

Figure 5:
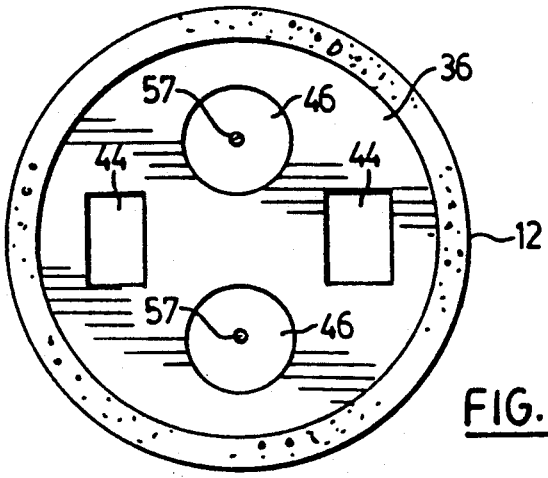
FIG. 5 is a bottom view of the stage of FIG. 4.

The top deck 30 contains winches 40 which support two "jumbos" or drills 42 (to be described), which drill the blast holes 16, 18. The drills 42, when not in use, are suspended at the level of deck 32 for access and maintenance by workers. When the drills 42 are to be used, they are lowered through holes in decks 32, 34, 36 to the bottom of the shaft for drilling. As shown in the plan view of FIG. 5, looking at the bottom of the stage, the decks 32, 34, 36 contains two rectangular openings 44 for the drills 42, and all the decks contain two additional circular openings 46 through which buckets 48 can move. It is noted that the stage 26 is normally about one foot smaller in diameter than that of the shaft lining 37 and may typically be between 18 and 23 feet in diameter. The openings 44 for the drills 42 may typically each be 3 feet by 5 feet, and the openings 46 for the buckets may typically be 6 feet in diameter.

Deck 34 contains, as is conventional, a concrete distribution box 50 (which receives concrete for the shaft lining), and pipes 52 and hoses 53 to distribute the concrete to the lining 37.

Bottom deck 36 is used by workers to install forms to form a section of shaft lining 37, e.g. a curb ring 54 or floor of the form, and the wall portions 55 of the form which rest on the curb ring. A "grab" 56 is also suspended from the bottom deck 36 and is used to lift broken rock into buckets 48. Two cables 57 extend through the openings 46, with a bucket 48 attached to the bottom of each cable. The buckets are used to hoist broken rock from the shaft and also to bring workers, explosives, and any other equipment needed into and out of the shaft. When the shaft is being sunk, the buckets 48 are normally the sole means of moving workers and material into and out of the shaft. (Economics require that the stage 26 be moved as infrequently as possible.) Conventionally the buckets 48 are arranged so that as one moves up, the other moves down, each acting as at least a partial counterweight for the other. The buckets are supported by large hooks 58, one at the end of each cable 59.

According to the embodiment of the invention being described, an ITH drill 60 (FIGS. 6 to 8) is lowered into the shaft either directly by hook 58 or (more usually) by being connected by chains 61 to the bottom of a bucket 48. The ITH drill 60 is lowered through one of the bucket openings 46 in the stage to the bottom 10 of the shaft, and is used to drill the relief hole 14 at the same time as drills 42 are used to drill the primary and secondary blast holes 16, 18. Since relief hole 14 is large, it will take much longer to drill than a single blast hole 16, 18. However since there are many blast holes 14, 16 to drill, the time taken to drill relief hole 14 is normally less than the time needed to drill all of the blast holes 16, 18.

Figure 6:
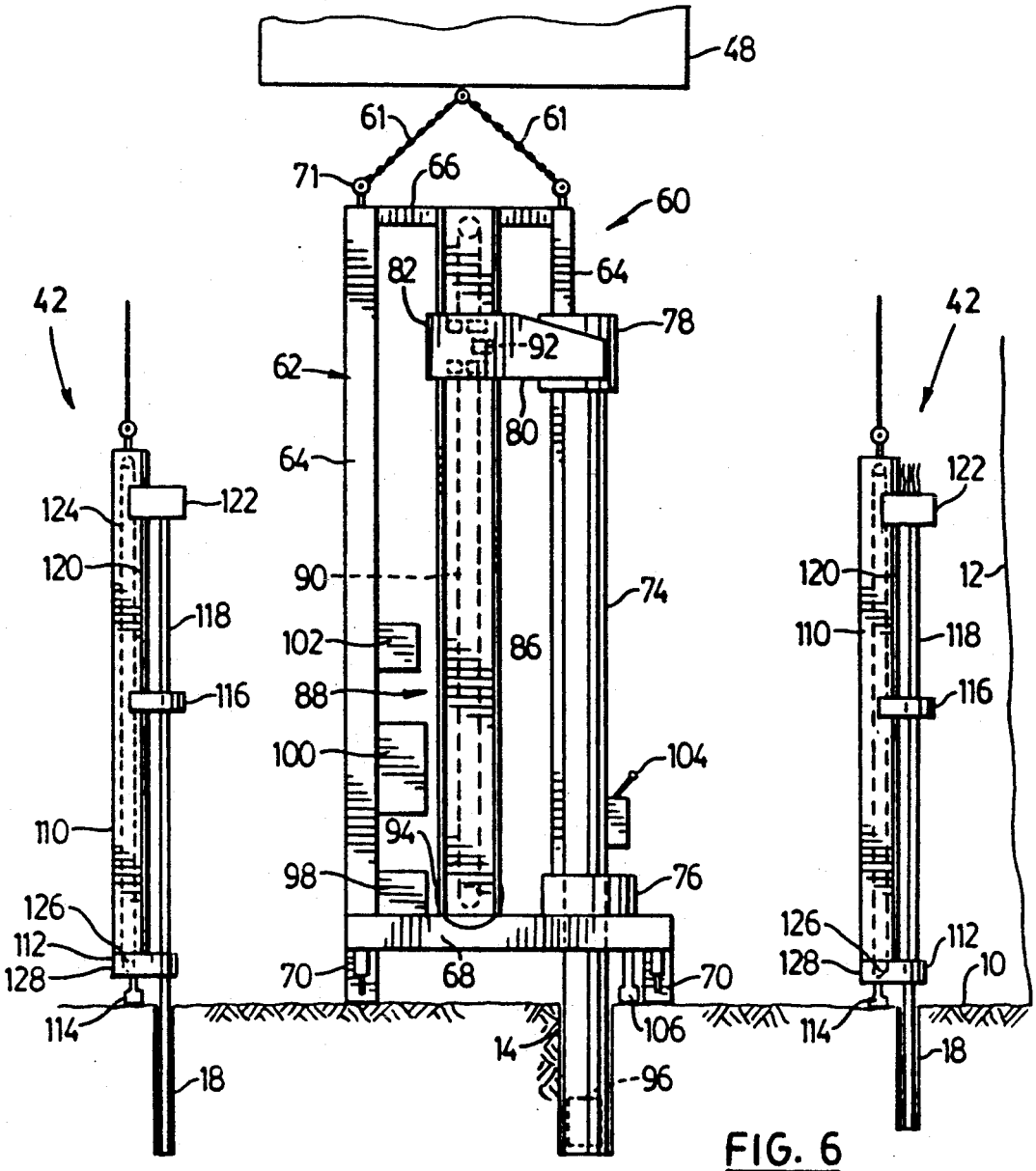
FIG. 6 is a side view of an in-the-hole (ITH) drill used with the stage of FIG. 4 and of two smaller drills used therewith.
Figure 8:
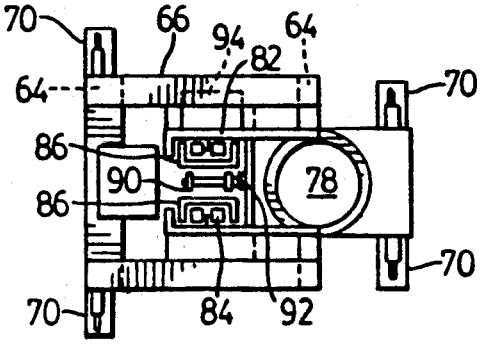
FIG. 8 is a top view of the ITH drill of FIG. 6.
Figure 7:
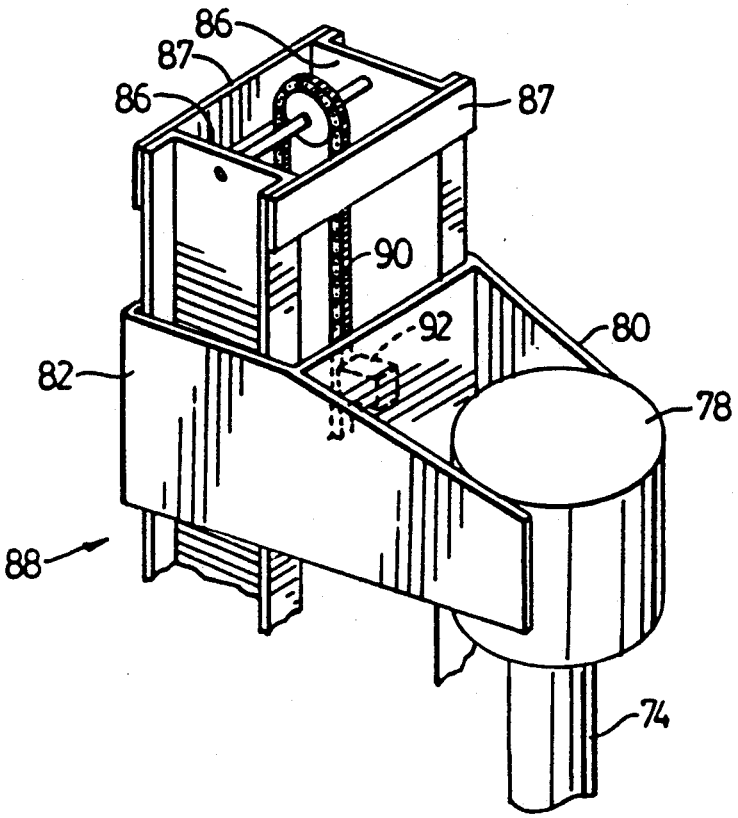
FIG. 7 is a perspective view of a portion of the ITH drill of FIG. 6.

The ITH drill 60 is illustrated diagrammatically in FIGS. 6 to 8. The ITH drill 60 includes a main frame 62 constructed of four vertical channel beams 64 welded to top and bottom rectangular frames 66, 68. Jacks 70 at the corners of the bottom of the frame 62 support the main frame 62 on the bottom 10 of the shaft for drilling in the required direction. Lifting lugs 71 at the top of the frame 62 serve as attachments for the chains 61 to hang the ITH drill 60 on the bottom of the hook 58 or bucket 48 when drill 60 is being raised or lowered.

As is usual for an ITH drill, the drill 60 includes a drill pipe 74 supported at its bottom by a fixed guide or centralizer 76. The upper end of the drill pipe 74 is connected to a hydraulic motor 78 mounted in a main frame 80. The main frame 80 includes two extensions 82 to which are connected inwardly facing rollers 84. The rollers 84 roll up and down two vertically extending outwardly facing channels 86 which are connected at their top and bottom by plates 87 to form a slide frame 88 for the motor frame 80. The slide frame 88 is rigidly connected at its upper and lower ends to the main frame 62. A chain 90 connected by member 92 to the motor frame 80 and to a hydraulic motor 94 moves the motor frame 80 and hence the drill pipe 74 up and down to feed the drill pipe 74 into and out of the relief hole 14 being drilled.

As is conventional, a hammer diagrammatically indicated at 96 is located within the drill pipe 74 and is powered pneumatically through a high pressure air hose (not shown) extending through the drill pipe. (Usually the air is about 300 psi.)

Also mounted on the frame 62 is a hydraulic tank 98 pressurized by an electric motor and pump 100, a hydraulic fluid cooler 102, and control levers 104 to control the rotation of the drill pipe 74, its movement up and down by hydraulic motor 94, and the operation of the hammer 96 in the drill pipe. A "stinger" 106 contacts the face 10 beside the drill pipe 74 to help stabilize the drill operation.

The blast hole drills 42, one of which is shown in FIG. 6, are of conventional construction and will be described only briefly. Each drill 42 includes a beam 110 having a fixed bushing or centralizer 112 at its lower end, and also having at its lower end a "stinger" 114 which supports the beam 110 against the rock of face 10 during drilling and provides stability. Each drill 42 also includes a travelling centralizer 116 which supports the drill string 118 and moves slidably, with the drill string, on flanges 120 of the beam 110. At the upper end of the beam 110 is located a hydraulic hammer drill 122 which rotates the drill string 118 and hammers on the drill string. The drill 122 is slidably mounted on flanges 120 of the beam 110 and is moved back and forth on the beam 110 by a chain 124 connected to a sprocket 126 driven by a hydraulic motor 128. The hydraulic motors are supplied with pressurized fluid supplied by a pump and an electric motor (not shown) located on the stage 26.

In operation, and as described, the ITH drill 60 is lowered from the surface, suspended from the end of a bucket 48, down the shaft 12, through an opening 46 in stage 26, to the bottom 10 of the shaft where it is positioned using jacks 70. At the same time, blast hole drills 42 are lowered through openings 44 and are also positioned for drilling. All three drills are then operated simultaneously. By way of example, in a 20 foot diameter shaft, in which 68 blast holes are drilled, it may typically take about 145 minutes to drill an 18 foot long relief hole 14 and 160 minutes to drill 18 foot long blast holes 16, 18. When the two sets of holes are drilled simultaneously, the drilling time is reduced nearly by half, as compared with drilling the holes separately. It will however be noted that after the relief hole 14 is drilled, the ITH drill 60 will normally be removed to allow drilling of the primary blast holes 16 immediately around the relief hole 14.

Since space at the bottom of the shaft 12, and also on the stage 26, is at a premium, and since the ITH drill 60 is large, normally the ITH drill 60 will be moved back to the surface when it is not in use, e.g. while the few remaining blast holes 16 next to the relief hole are being drilled. ITH drill 60 will not, because of its size, normally be stored on the stage 26.

The use of a large relief hole 14 enables much longer rounds (i.e. much longer depths of holes for each cycle) to be drilled than had previously been thought possible. Previously, it had been necessary to drill the blast holes 16, 18 precisely parallel (or else drill an uneconomic number of blast holes), and in hard rock, it was not normally possible with long rounds to keep the blast holes precisely parallel. Even with shorter rounds, a very high degree of experience and skill were required. However with a large relief hole drilled deeper than the blast holes, fewer blast holes are needed, so they can be kept well within their critical distances and it is then not essential that they be precisely parallel. Therefore, the level of skill and experience needed to drill them is significantly lowered.

Preferably each round according to the method of the invention is at least 4.5 meters (15 feet), and more usually 5.5 meters (18 feet). Each round may be as long as 9.1 meters (30 feet). Whether a long or a short round is being drilled, certain fixed times, such as the setup time and the packup time remain fixed, and it is found that the overall efficiency, using a long round, can be improved by about 20 percent as compared with conventional methods using shorter rounds.

Figure 10:
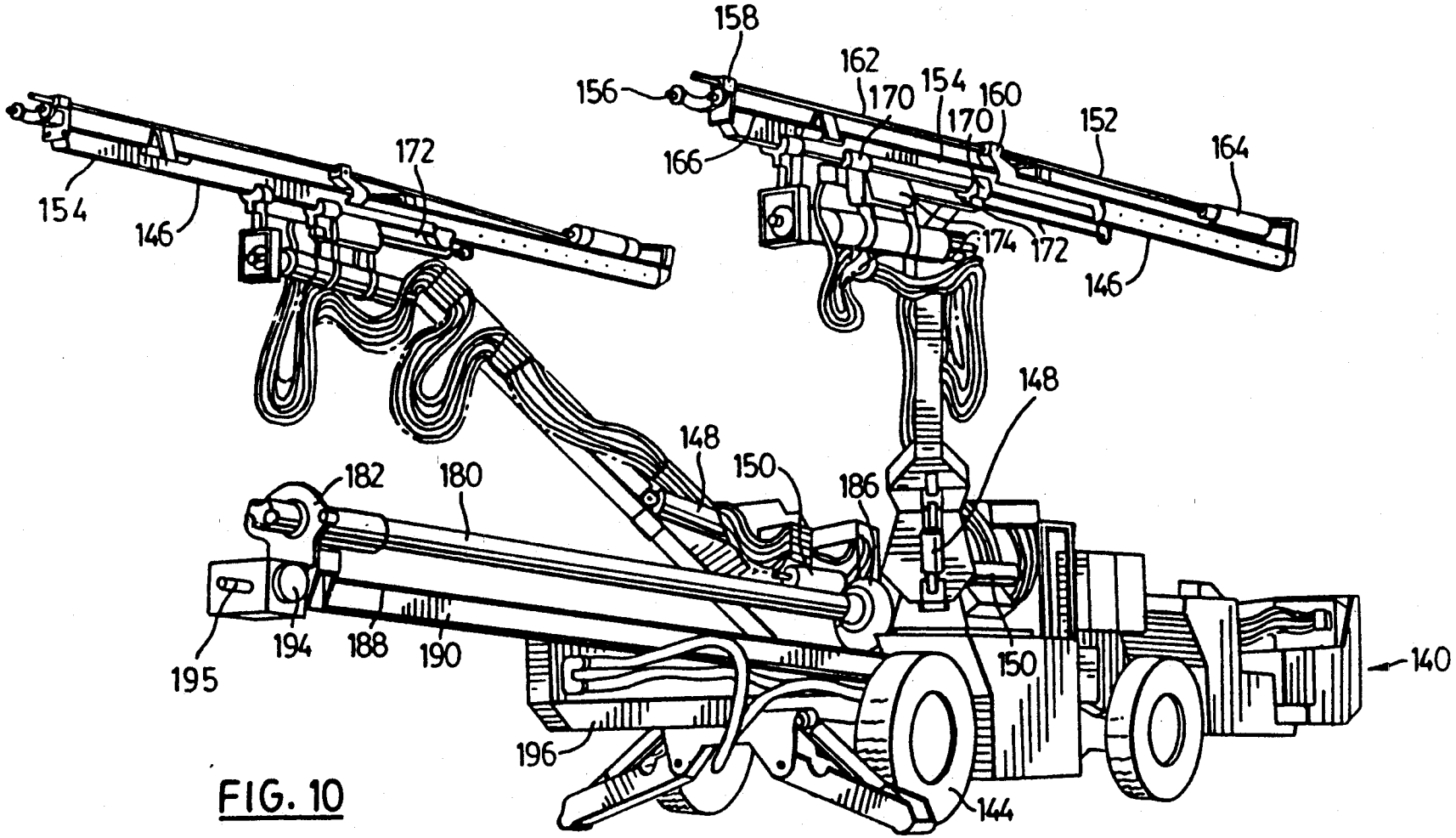
FIG. 10 is a perspective view of the FIG. 9 machine.
Figure 9:
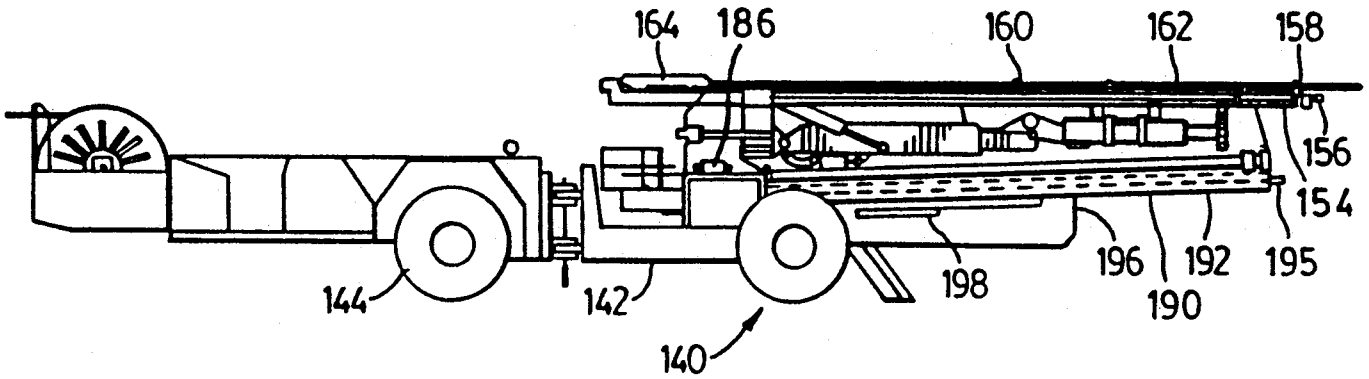
FIG. 9 is a side view showing a machine fitted with an ITH drill and smaller drills for excavating a tunnel.

Reference is next made to FIGS. 9 and 10, which show an embodiment of the invention used for excavating in tunnels (commonly called drifts in underground mines). A vehicle 140 has a conventional articulated chassis 142 and wheels 144. Mounted on the chassis 144 are two Montabert BUC 35 (trade mark) booms 146, movable vertically by hydraulic cylinders 148, and rotatable horizontally (through a relatively small arc) by further cylinders 150. Each boom carries a conventional blast hole drill 152. As previously described, each blast hole drill 152 includes a beam 154 on which are mounted a "stinger" 156, a front fixed centralizer 158, a travelling centralizer 160, and a drill string 162 which extends through the centralizers 158, 160 and is operated by a hydraulic hammer drill motor 164 at the back of the beam 154. The drill motor 164 and travelling centralizer 160 slide back and forth on the beam 154 on flanges 166 of the beam. Again a chain (not shown but inside beam 154) connected to a hydraulic motor (not shown) pulls the drill motor 164 and hence the drill string 162 back and forth on the beam 154.

In order to help position the drill against the face of the drift, the beam 154 is slidably mounted on a slide 170 beneath the boom 184. A piston and cylinder 172 connected between the slide 170 and the beam 154 move the beam back and forth on the slide. The slide 170 is connected by a hinge 174 to the end of the boom 146 and is pivoted on hinge 174 by any desired means, such as a piston and cylinder (not shown).

The relief hole drill string 180 is much larger and heavier than drill string 162 and is supported on a fixed front centralizer 182 and at its rear by a motor 186. The motor 186 is slidably mounted on the flanges 188 of a forwardly projecting box beam 190 and is propelled forwardly and rearwardly on beam 190 by a chain 192 within the beam and connected to a hydraulic motor 194. At its front the beam 190 carries a stinger 195 which contacts the face during drilling, as previously described.

The beam 190 is itself slidably mounted for forward and rearward movement on a large support member 196. Beam 190 is moved forwardly and rearwardly on support member 196 by a piston and cylinder 198, and slopes upwardly at an angle of about 5 degrees. This incline provides a clean face for drilling the next relief hole 14 when the previous hole has been blasted. The double forward and rearward movement described (i.e. by the drill string 180 on beam 190, and by beam 190 on support 196) is needed since otherwise the vehicle 140 would be inconveniently long for use in drilling long (e.g. 18 to 30 foot) rounds.

In FIG. 9 the slides or beams 154, 190 are shown retracted for travelling. In FIG. 10 the left hand beam 154 is extended in the drilling position.

Figure 11:
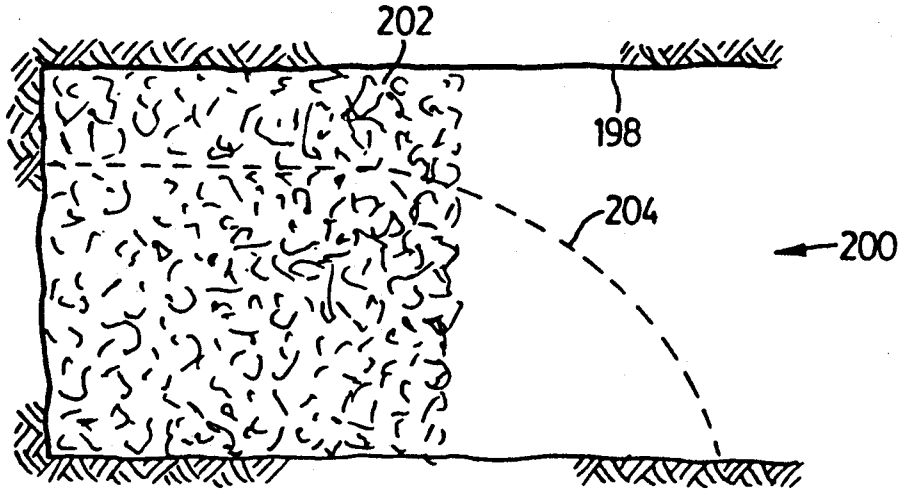
FIG. 11 is a diagrammatic view of a drift after blasting using the method of the invention.

In use, a pattern of holes essentially the same as previously described is drilled in the tunnel face. Again the relief hole (at least 200 mm diameter and preferably 250 mm diameter or larger) is drilled at least 5 to 15 percent deeper than the blast holes, to improve the fragmentation of rock and to ensure that there will be no bootlegs. It was found, when drilling 25 and 30 foot rounds, in a drift approximately 14 feet high by 14 feet wide, that an unusual development occurred during blasting. Normally, as shown in FIG. 11, after blasting, the fragmented rock or muck which is produced is piled to the roof 198 of the tunnel 200, as indicated at 202. However with the invention, it was found that the fragmented rock or muck was piled as indicated by dotted line 204, i.e. the pile did not extend to the roof of the drift. Since the muck pile did not extend to the roof, it had a lesser tendency to choke the blast. In addition, it was found that the muck pile was "looser" or "fluffier", and was therefore easier to remove. In addition the time needed to excavate the drift was far less than had previously been needed.

We claim:

1. A method for breaking a long round in a full face of rock, for use in the construction of shafts and tunnels, said method comprising the following steps:

(a) drilling a relief hole having a first diameter of at least 200 millimeters and a first depth, said first depth being at least 4.5 meters, and simultaneously with the drilling of said relief hole, drilling a plurality of primary and secondary blast holes about said relief hole, said blast holes being approximately axially parallel to said relief hole and having a second depth and a second diameter each of which is respectively less than said first depth and said first diameter, where the periphery of each of said primary blast holes is located less than a critical radial distance from the periphery of said relief hole as measured from the nearest points between the peripheries of the respective holes, and where said secondary blast holes are located a further distance radially from said relief hole than said primary blast holes, (b) inserting explosive charges into said relief hole and into a plurality of said primary and secondary blasting holes, (c) detonating said charges in a prearranged detonation sequence with the explosive charges in said relief hole being detonated first, and the explosive charges in said primary blast holes being detonated next.

2. The method as claimed in claim 1, wherein said first depth is at least 10 percent greater than said second depth.

3. The method as claimed in claim 2, wherein said first diameter is at least 250 millimeters.

4. The method as claimed in claim 3, wherein said second diameter is approximately 45 millimeters.

5. The method as claimed in claim 4, wherein said blast holes are drilled with an electric hydraulic drill.

6. The method as claimed in claim 3 wherein said first depth is between 4.5 and 9.1 meters.

7. The method as claimed in claim 3 wherein said first diameter is approximately 250 mm and said second diameter is approximately 45 mm.

8. A method as claimed in claim 3 wherein said relief hole is drilled with an in-the-hole hammer drill, and wherein after said relief hole has been drilled, said in-the-hole hammer drill is removed from said face and at least some of said primary blast holes are drilled adjacent said relief hole.

9. The method as claimed in claim 1 wherein said relief hole is drilled with an in-the-hole hammer drill.

10. A method according to claim 1 wherein said face is the bottom of a shaft, said relief hole is drilled with an in-the-hole hammer drill, said blast holes are drilled with a plurality of electric hydraulic drills, and said method including the steps of positioning a stage in said shaft, suspending said electric hydraulic drills from said stage, moving said in-the-hole hammer drill down through an opening in said stage to said face during drilling of said relief hole, and after said relief hole has been drilled, then moving said in-the-hole hammer drill upwardly through said opening in said stage to a location above said stage.

11. A method according to claim 10 and including the step, after said relief hole has been drilled and said in-the-hole hammer drill has been moved upwardly above said relief hole, of drilling at least some of said primary blast holes adjacent said relief hole.

* * * * *

US005232268A

REEXAMINATION CERTIFICATE (2572nd)

United States Patent [19]

[11] B1 5,232,268

Dengler et al.

[45] Certificate Issued May 9, 1995

[54] METHOD OF BREAKING A FULL FACE OF ROCK FOR CONSTRUCTING SHAFTS AND TUNNELS

[75] Inventors: William R. Dengler, Nobleton; William M. Shaver, Stouffville, both of Canada

[73] Assignee: Dynatec International Limited, Richmond Hill, Canada

Reexamination Request:
No. 90/003,471, Jun. 22, 1994

Reexamination Certificate for:

| | |
|---|---|
| Patent No.: | **5,232,268** |
| Issued: | **Aug. 3, 1993** |
| Appl. No.: | **904,724** |
| Filed: | **Jun. 26, 1992** |

[30] Foreign Application Priority Data

Apr. 1, 1992 [CA] Canada ..... 2064625

[51] Int. Cl.[6] ..... F42D 3/04; E21D 1/00

[52] U.S. Cl. ..... 299/13; 102/312; 173/184

[58] Field of Search ..... 299/13, 57; 102/311, 102/312, 313; 173/28, 184

[56] References Cited

PUBLICATIONS

Reprint from Mining Engineering, Mar. 1993 of article entitled "New technology in shaft sinking/the Craig project".

New Technology In Shaft Sinking—Craig Project, William R. Dengler, et al., at the Rapid Excavation and Tunnelling Conference, Seattle, Washington, United States on Jun. 16 to 20, 1991 and published in the Proceedings for that conference (undated).

Full-Faced Shaft Sinking At Atomic Energy Of Canada Limited's Underground Research Laboratory, presented by Tim Bryson, et al., at the Ninth CIM Underground Operators Conference, Sudbury, Ontario, Canada on Feb. 19 to 22, 1989 and published in the attendee handouts for that conf.

Innovation And Perseverance, Breaking New Ground In Hard Rock Shaft Sinking In the 1990's, presented by Morris J. Medd, et al., at the CIM Annual Convention, Ottawa, Ontario, Canada, May 6 to 10, 1990 and published in the CIM Bulletin in Jan. 1991.

*Primary Examiner*—David J. Bagnell

[57] ABSTRACT

A method for breaking a longer round more efficiently in a full face of rock, to construct shafts or tunnels. In the method a relief hole having at least a 200 mm diameter and at least a 15 to 18 foot depth is drilled. Primary and secondary blast holes are drilled about the relief hole, approximately axially parallel to the relief hole. Most of the blast holes are drilled simultaneously with the relief hole. The relief hole is drilled by an in-the-hole (ITH) hammer drill, which if necessary is removed after drilling the relief hole, to allow blast holes to be drilled immediately adjacent the relief hole. The relief hole is drilled at least 10 to 15 percent deeper than the blast holes. Explosive charges are then inserted into the relief hole and most of the blast holes and are detonated in sequence.

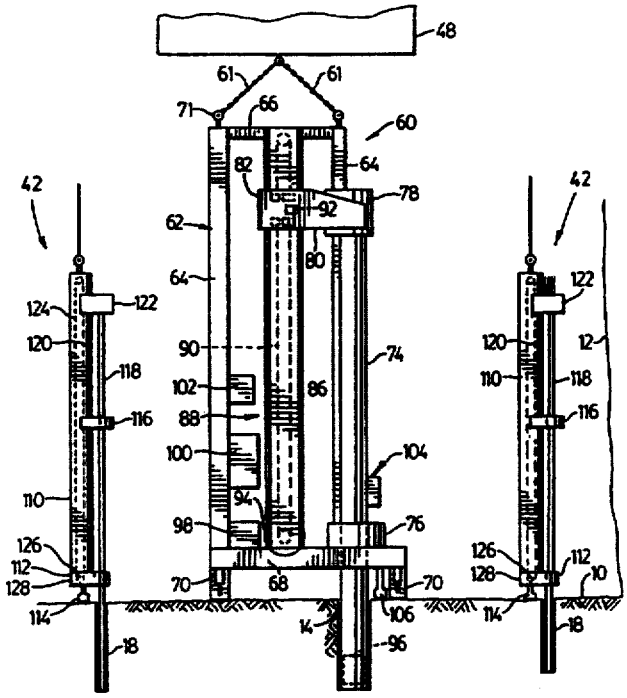

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claim 1 is determined to be patentable as amended.

Claims 2–11, dependent on an amended claim, are determined to be patentable.

New claims 12–16 are added and determined to be patentable.

1. A method for breaking a long round in a full face of rock, for use in the construction of shafts and tunnels, said method comprising the following steps *for each round:*

(a) drilling a relief hole having a first diameter of at least 200 millimeters and a first depth, said first depth being at least 4.5 meters, and simultaneously with the drilling of said relief hole, drilling a plurality of primary and secondary blast holes about said relief hole, said blast holes being approximately axially parallel to said relief hole and having a second depth and a second diameter each of which is respectively less than said first depth and said first diameter, where the periphery of each of said primary blast holes is [located less than] *positioned in a radial band disposed outside the periphery of said relief hole but within* a critical radial distance from the periphery of said relief hole as measured from the nearest points between the peripheries of the respective holes *so as to cause effective fragmentation of said rock,* and where said secondary blast holes are located a further distance radially from said relief hole than said primary blast holes, (b) inserting explosive charges into said relief hole and into a plurality of said primary and secondary [blasting] *blast* holes, (c) detonating said charges in a prearranged detonation sequence with the explosive charges in said relief hole being detonated first, and the explosive charges in said primary blast holes being detonated next.

*12. A method for breaking a long round in a full face of rock for use in construction of shafts and tunnels comprising the steps of:*

*(a) drilling, for each round of rock to be broken, a relief hole, said relief hole having an axis generally perpendicular to the rock face and having a diameter of at least 200 millimeters and a first depth, said first depth being at least 4.5 meters;*

*(b) simultaneously with the step of forming said relief hole, drilling a plurality of primary and secondary blast holes about said relief hole, said blast holes having a second depth and a second diameter each of which is respectively less than said first depth and said first diameter, the primary blast holes being positioned within an annular band extending radially about said relief hole but disposed within a critical radial distance from the periphery of the relief hole such that the distance from the peripheries of each of said primary blast holes to the periphery of the relief hole is within said critical range, each of said blast holes having an axis oriented at least generally parallel to the axis of said relief hole, the secondary blast holes being disposed radially further from said relief hole than the primary blast holes; said blast holes being charged with explosive charges which, when detonated in a prearranged sequence, will cause rock to break into said relief hole;*

*(c) clearing said relief hole using an explosive charge contained therein prior to detonating the charges in said primary blast holes.*

*13. The method according to claim 12, wherein the step of simultaneously forming further comprises forming at least two primary blast holes at generally equal circumferential intervals about the periphery of said relief hole.*

*14. The method according to claim 12, wherein said long round is broken in connection with construction of a generally vertical shaft and wherein said first depth is at least 10% deeper than said second depth.*

*15. The method according to claim 14, wherein said first depth is at least about 15% deeper than said second depth.*

*16. The method according to claim 12, wherein said long round is broken in connection with construction of a generally horizontal shaft and said first depth is between about 5% to about 10% deeper than said second depth.*

* * * * *

US005232268B1

REEXAMINATION CERTIFICATE (3028th)

United States Patent [19] [11] B2 5,232,268

Dengler et al. [45] Certificate Issued Oct. 15, 1996

[54] METHOD OF BREAKING A FULL FACE OF ROCK FOR CONSTRUCTING SHAFTS AND TUNNELS

[75] Inventors: William R. Dengler, Nobleton; William M. Shaver, Stouffville, both of Canada

[73] Assignee: Dynatec International Limited, Richmond Hill, Canada

Reexamination Request:
No. 90/003,756, Mar. 21, 1995

Reexamination Certificate for:

| | |
|---|---|
| Patent No.: | **5,232,268** |
| Issued: | **Aug. 3, 1993** |
| Appl. No.: | **904,724** |
| Filed: | **Jun. 26, 1992** |

Reexamination Certificate B1 5,232,268 issued May 9, 1995

[30] Foreign Application Priority Data

Apr. 1, 1992 [CA] Canada ..... 2064625

[51] Int. Cl.[6] ..... F42D 3/04; E21D 1/00

[52] U.S. Cl. ..... 299/13; 102/312; 173/184

[58] Field of Search ..... 299/13, 57

[56] References Cited

PUBLICATIONS

Lautman, K.-F., New Drilling and Blasting Techniques for Deeper Drift Rounds, Drilling and Blasting Symposium, Colorado School of Mines, 1961. pp. 261–273, 286–289, 325–328.

Andrews, K. E. et al., Some Aspects of High Speed Hard Rock Tunnelling in the Snowy Mountains, IEA transactions, vol. CE6, 1964. pp. 1–11.

Gritzuk, N. Tunnel Driving at Granduc, Mining Congress Journal, Oct. 1969. pp. 67–69.

Cummins, A. B. and Given, I. A., SME Mining Engineers Handbood, Society of Mining Engineers of the American Institute of Mining, Metallurgical and Petroleum Engineers, Inc., New York, 1973, Section 11, pp. 11–67.

Schmidt, R. L. et al., Application of Large Hole Burn Cut in Room and Pillar Mining, Report of Investigations 7994, Twin Cities Mining, Research Centre, U.S. Dept. of Interior, Bureau of Mines. Dec. 1974.

The Use of Parallel Hole Cuts in Long Development Rounds, Explosives Today Series 2 No. 2, AECI Explosives and Chemicals Ltd., Oct. 1976.

Dupont, Blaster's Handbook, 175th Anniversary Edition, 1977, pp. 265–270.

Langefors, U. and Kihlstrom, B., The Modern Technique of Rock Blasting, Third Edition, Halsted press Book, 1978, pp. 182 to 186, 216 to 217, 230 to 234, 241 to 246.

Hoek, E. and Brown, E. G., Underground Excavations in Rock, The Institution of Mining and Metallurgy, London, 1980, pp. 367 to 381.

Hemphill, Gary B., Blasting Operations, McGraw-Hill Book Company, 1981 pp. 176 to 177.

Atlas Copco Manual, Fourth Edition, Sweden 1982, pp. 257 to 262.

Tomrock, Handbook of Underground Drilling, Satapaino, Finland, 1983, pp. 36, 37, 69.

Hastrulid, W. A., Underground Mining Methods Handbook, Society of Mining Engineers of the American Institute of Mining, Metallurgical, and Petroleum Engineers, Inc., New York, 1982, pp. 1580 to 1589.

(List continued on next page.)

*Primary Examiner*—David J. Bagnell

[57] ABSTRACT

A method for breaking a longer round more efficiently in a full face of rock, to construct shafts or tunnels. In the method a relief hole having at least a 200 mm diameter and at least a 15 to 18 foot depth is drilled. Primary and secondary blast holes are drilled about the relief hole, approximately axially parallel to the relief hole. Most of the blast holes are drilled simultaneously with the relief hole. The relief hole is drilled by an in-the-hole (ITH) hammer drill, which if necessary is removed after drilling the relief hole, to allow blast holes to be drilled immediately adjacent the relief hole. The relief hole is drilled at least 10 to 15 percent deeper than the blast holes. Explosive charges are then inserted into the relief hole and most of the blast holes and are detonated in sequence.

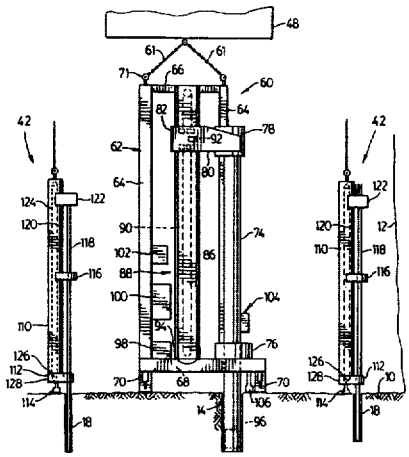

PUBLICATIONS

Wild, Heinz, Walter, Sprengtechnik in Bergbau, Tunnel—und Stollenbau sowie in Tagebauen und Steinbruchen, Verlag Gluckauf GmbH, Essen, Germany, 1984, pp. 102 to 113.
Brady, J. J. et al., Practical Methods of Shallow Shaft Sinking AIME–ASCE Rapid Excavation and Tunneling Conference, Proceedings vol. 2, New York, 1985.
Steward, A. J. Mount Mcdonald Tunnel, AIME–ASCE Rapid Excavation and Tunnelling Conference, Proceedings, vol. 1, New Orleans, 1987.
Soutar, B. N. and O'Connor, R. H., The Introduction of Mechanical Shaft Drilling in the Gold Fields Group, Journal of the South African Institute of Mining and Metallurgy, Nov. 1988 pp. 369 to 377.
Hagan, T. N. et al., Design, Implementation and Monitoring of Full–face Blasts to Extend a Shaft at Atomic Energy of Canada Ltd.'s Underground Research Laboratory, Shaft Engineering, Institution of Mining and Exploration, Inc., Transactions, vol. 286, 1989.
Kuzuk, G. W. R. and Versluis, W. S., Full–face Shaft Sinking at the Energy of Canada Ltd. Underground Research Laboratory, Society for Atomic Mining, Metallurgy, and Exploration, Inc. Trans. vol. 286, 1989.
Bullock, Richard L., Fundamental Research on Burn Cut Rounds, Third Annual Symposium on Mining Research, Rolla Mo. 1957, pp. 84 to 122.
Yancik, J. J. and Clark, G. B., Experimentation with Large Hole Burn Cut Drift Rounds, University of Missouri School of Mines Bulletin, No. 93, 1956.

Chadwick, John R., Cardona—Spain's Sublevel Open Stope Potash Mine, World Mining, May 1980, pp. 48 to 50.

Atlas Copco Manual, Jumbo Shaft Sinking Drill (undated).

Ingersoll–Rand, Big Burn–Hole Method, 1960.

New Technology in Shaft Sinking—Craig Project, William R. Dengler, et al., at the Rapid Excavation and Tunnelling Conference, Seattle, Washington, United States on Jun. 16 to 20, 1991 and published in the Proceedings for that conference ("the Dengler Publication").

Full–Faced Shaft Sinking at Atomic Energy of Canada Limited's Underground Research Laboratory, presented by Tim Bryson, et al., at the Ninth CIM Underground Operators Conference, Sudbury, Ontario, Canada on Feb. 19 to 22, 1989 and published in the attendee handouts for that conf.

Innovation and Perseverance, Breaking New Ground in Hard Rock Shaft Sinking in the 1990's, presented by Morris J. Medd, et al., at the CIM Annual Convention, Ottawa, Ontario, Canada, May 6 to 10, 1990 and published in the CIM Bulletin in January 1991 ("the Medd Publication").

REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1–16 are cancelled.

* * * * *